US006846061B2

(12) United States Patent
Nakashima

(10) Patent No.: US 6,846,061 B2
(45) Date of Patent: Jan. 25, 2005

(54) INK-JET RECORDING APPARATUS

(75) Inventor: Atsuhisa Nakashima, Handa (JP)

(73) Assignee: Brother Kogyo, Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/668,500

(22) Filed: Sep. 24, 2003

(65) Prior Publication Data

US 2004/0113973 A1 Jun. 17, 2004

(30) Foreign Application Priority Data

Sep. 25, 2002 (JP) ..... 2002-278784

(51) Int. Cl.[7] ..... B41J 2/165; B41J 2/185

(52) U.S. Cl. ..... 347/22; 347/33; 347/36; 400/635

(58) Field of Search ..... 347/22, 33, 36, 347/104; 400/635; 271/275, 276

(56) References Cited

U.S. PATENT DOCUMENTS 4,207,578 A * 6/1980 Marinoff ..... 347/35
5,040,000 A * 8/1991 Yokoi ..... 347/30
5,517,222 A * 5/1996 Sugiyama et al. ..... 347/35
6,672,705 B2 * 1/2004 Kitahara et al. ..... 347/42
6,742,864 B2 * 6/2004 Therien et al. ..... 347/36

FOREIGN PATENT DOCUMENTS

JP A 2001-113690 4/2001
JP A 2001-287377 10/2001

* cited by examiner

*Primary Examiner*—Daniel J. Colilla
*Assistant Examiner*—Jill E. Culler
(74) *Attorney, Agent, or Firm*—Oliff & Berridge, PLC

(57) ABSTRACT

In an ink-jet printer, flushing region is arranged in a part of a conveyor belt. In a flushing operation, the ink-jet head ejects ink onto the flushing region. An ink mover is arranged confronting the conveyor belt. Ejected ink onto the flushing region is moved by the ink mover toward an opening arranged adjacent to the flushing region. An ink retainer is arranged confronting the ink mover under the conveyor belt, and thereby ink moved by the mover and passed through the opening is retained by the ink retainer.

17 Claims, 5 Drawing Sheets

INK-JET RECORDING APPARATUS

BACKGROUND OF THE INVENTION

1. Field of the Invention

The present invention relates to an ink-jet printing apparatus that ejects ink onto a record medium for recording thereon.

2. Description of the Related Art

An ink-jet recording apparatus is an apparatus that causes ink ejected from nozzles formed in heads to adhere to paper to thereby form a desired image on the paper. In such an ink-jet recording apparatus, a belt conveying mechanism is sometimes used as a mechanism for conveying the paper serving as a recording medium.

In an ink-jet recording apparatus, when the state where ink is not ejected from the nozzles continues for a long period of time, the surfaces of the ink meniscuses become dry and poor ink ejection arises. In order to prevent this, it is necessary to periodically conduct so-called flushing in which the ink is forcibly ejected from the nozzles towards a location other than the paper when printing is not being conducted.

In the case of a serial-type ink-jet recording apparatus where the heads reciprocatingly move in a direction orthogonal to the conveying direction of the paper, flushing can be rapidly conducted by moving the heads to a position offset from the paper conveying path when printing is not being conducted. However, in the case of a line-type ink-jet recording apparatus where the heads are fixedly disposed along the direction orthogonal to the paper conveying direction, for example, when the aforementioned belt conveying mechanism is adopted as the paper conveying mechanism, it is necessary to move an ink receiving member to a position facing the heads after the belt conveying mechanism or the heads has/have been retreated. Therefore, the rapid flushing is difficult to carry out.

Thus, techniques have been developed that enable rapid flushing in a line-type ink-jet recording apparatus employing a belt conveying mechanism. In an example, an opening is disposed in a portion of the conveyor belt, and a recovery mechanism including an absorber is disposed at a position facing the heads under the conveyor belt. When the opening in the conveyor belt is below the heads, ink is ejected towards the opening and absorbed by the recovery mechanism.

Due to such an arrangement of the above technique in which the recovery mechanism is disposed confronting the heads under the conveyor belt, a flexure prevention member such as a flat plate cannot be disposed on a substrate undersurface of the conveyor belt confronting the heads. In case of the absence of the flexure prevention member, there is a problem in that excellent image formations cannot be implemented as a result of the conveyance belt flexing in the printing region.

SUMMARY OF THE INVENTION

It is therefore the object of the present invention to provide an ink-jet printing apparatus capable of rapid flushing and of keeping the conveyor belt flat, to thereby implement excellent image formations.

According to an aspect of the present invention there is provided an ink-jet recording apparatus comprising: a plurality of rollers; a conveyor spanned the plurality of rollers for conveying a record medium thereon, the conveyor including a conveying surface on which a record medium is conveyed, a flushing region onto which ink is ejected when flushing is performed, and an opening arranged adjacent to the flushing region; an ink-jet head arranged confronting the conveyor belt, for ejecting ink onto the flushing region of the conveyor belt; an ink mover for moving ink ejected from the ink-jet head onto the flushing region toward the opening, the ink mover arranged confronting the conveyor belt; and an ink retainer for retaining ink moved by the ink mover and passed through the opening, the ink retainer arranged confronting the ink mover under the conveyor belt.

The above arrangement is such that ink ejected onto the flushing region of the conveyor belt in a flushing operation is moved by the ink mover toward the opening and that the ink passed through the opening is retained in the reservoir. Thus, the above arrangement eliminates the need to retreat the conveyor belt or the heads at the time of flushing, to ensure a rapid flushing. Also, such an arrangement is possible that the movement of ink by the ink mover occurs at regions not confronting the ejecting surfaces of the ink-jet heads. In this case, the ink retainer is arranged at a region not confronting the ejecting surfaces of the ink-jet heads. Therefore, it is possible for a flexure prevention member such as a flat plate to be arranged on a substrate undersurface of the conveyor belt confronting the heads. The flexure prevention member enables the conveyor belt to be kept flat in the printing region, to thereby realize excellent image formations.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
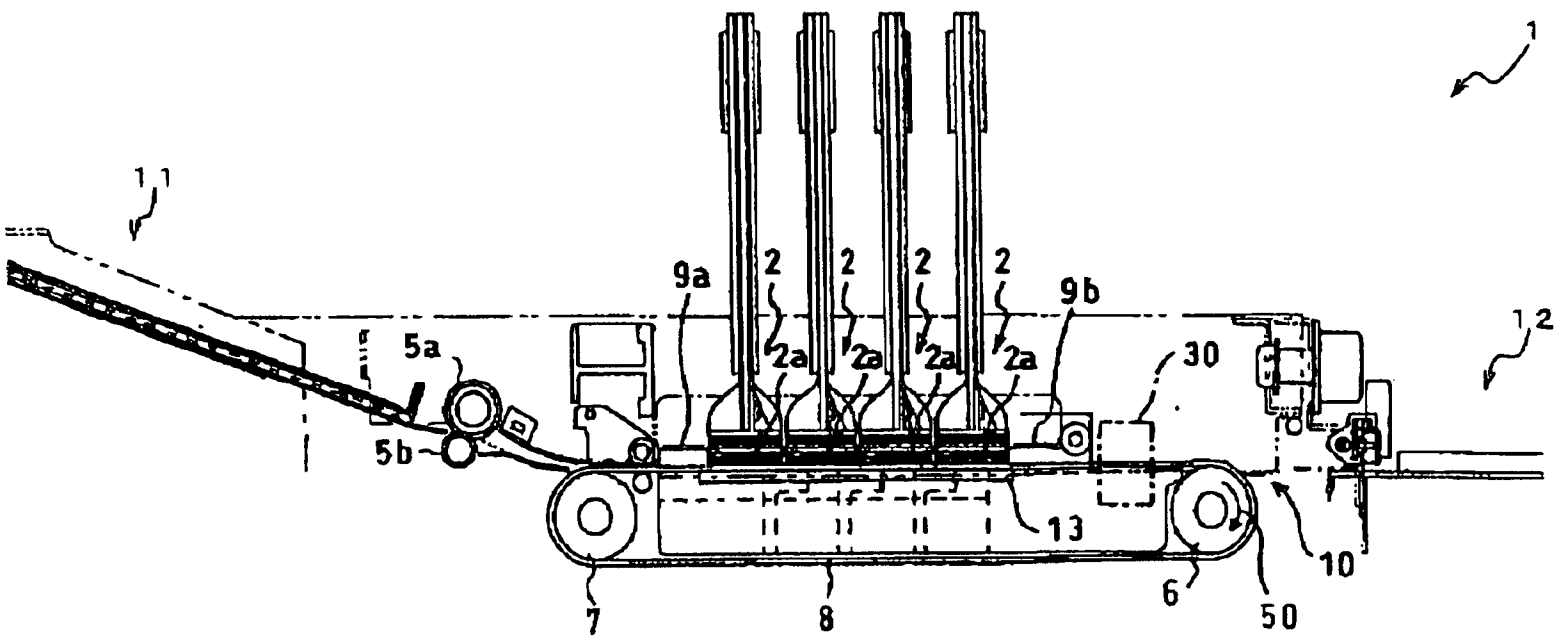
FIG. 1 is a front elevational view of an ink-jet printer, i.e., an ink-jet recording apparatus in accordance with an embodiment of the present invention.

First, referring to FIG. 1, description will be made of the overall configuration of an ink-jet printer, i.e., an ink-jet recording apparatus in accordance with an embodiment of the invention. The ink-jet printer of this embodiment is generally designated at 1 and is a color ink-jet printer provided with four ink-jet heads 2. The ink-jet printer 1 includes a paper feed section 11 on the left in FIG. 1 and a paper discharge section 12 on the right in FIG. 1. A paper conveying path extending from the paper feed section 11 to the paper discharge section 12 is formed inside the apparatus.

A pair of paper feed rollers 5*a* and 5*b* are arranged immediately downstream of the paper feed section 11. Paper serving as a recording medium is sent from left to right in the diagram. At an intermediate portion of the paper conveying path are arranged two rollers 6 and 7 and an endless conveyor belt 8 that is spanned the rollers 6 and 7 so as to span the distance therebetween.

The conveyor belt 8 has a two-layer structure of a meshed polyester base material 8*y* impregnated with urethane, and a silicone rubber sheet 8*x* adhered to the external surface of the base material (see FIG. 3), with the surface being made of silicone rubber. Paper conveyed by the pair of paper feed rollers 5*a* and 5*b* is retained by attraction on the conveying surface of the conveyor belt 8 surface and is conveyed downstream in the conveying direction, i.e., toward the right in the diagram, by the driving force of the roller 6 being rotated clockwise, i.e., in the direction of arrow 50.

Press members 9*a* and 9*b* are arranged respectively upstream and downstream of the head 2 in the traveling direction of the conveyor belt 8. The press members 9*a* and 9*b* serve to press paper against the conveying surface of the conveyor belt 8 to ensure that the paper on the conveyor belt 8 does not rise from the conveying surface and that the paper is reliably conveyed on the conveying surface. A flexure prevention member 13 in the form of, e.g., a flat metal plate is arranged at an underside of the conveyor belt 8 confronting the heads 2.

A separation mechanism 10 is arranged downstream, i.e., to the right in the diagram, of the conveyor belt 8 in the conveying direction along the paper conveying path. The separation mechanism 10 separates the paper, which is retained by attraction on the conveying surface of the conveyor belt 8, from the conveying surface, and send the paper towards the paper discharge section 12 at the right side.

The four ink-jet heads 2 respectively include a head main body 2*a* at lower ends thereof. Each head main body 2*a* has a rectangular cross section, and the head main bodies 2*a* are arranged in mutual proximity so that the longitudinal direction thereof is a direction perpendicular to the paper conveying direction, i.e., a direction perpendicular to the drawing plane of FIG. 1. In other words, the printer 1 is a line-type printer. A multiplicity of nozzles are arranged in each bottom surface of the four head main bodies 2*a*, and magenta, yellow, cyan and black inks are respectively ejected from the four head main bodies 2*a*.

Each head main body 2*a* is arranged confronting the surface of the conveyor belt 8 such that a small gap is formed between the undersurface of the head main body and the conveying surface of the conveyor belt 8. The paper conveying path is formed in the gap portion. Thus, when the paper conveyed by the conveyor belt 8 successively passes directly below the four head main bodies 2*a*, the inks of the respective colors are ejected from the nozzles towards the surface of the conveyor belt 8, whereby a desired color image can be formed on the paper.

In a region of the conveyor belt 8 not confronting the ejecting surfaces of the ink-jet heads 2, an ink movement position is defined on the paper conveying path between the separation mechanism 9*b* and the roller 6. A photosensor 40 is arranged a long the lower path of the conveyor belt 8 at a position confronting the ink movement position 30, for detecting the position of the conveyor belt 8, more specifically the position of an opening 80 which will be later. The photosensor 40 includes a light-emitting unit 40*a* and a light-receiving unit 40*b* which are confrontingly arranged inside and outside respectively of the conveyor belt 8.

Figure 2A:
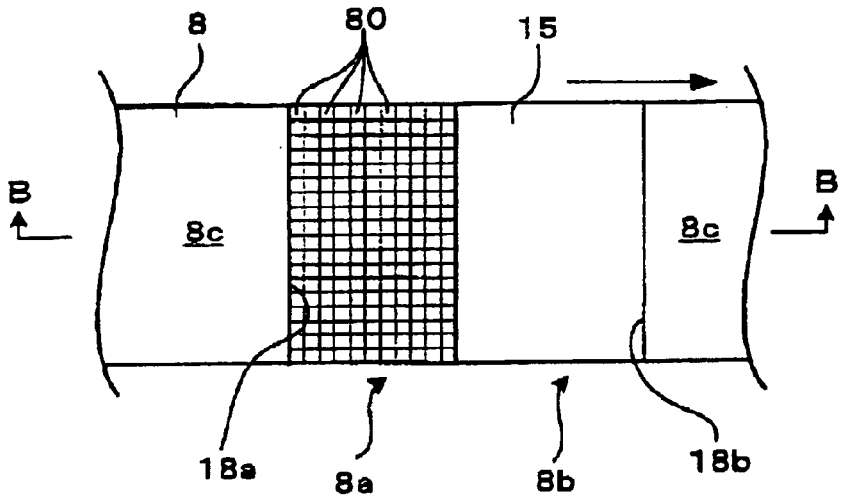
FIG. 2A is a schematic top view of a conveyor belt depicted in FIG. 1.
Figure 2B:
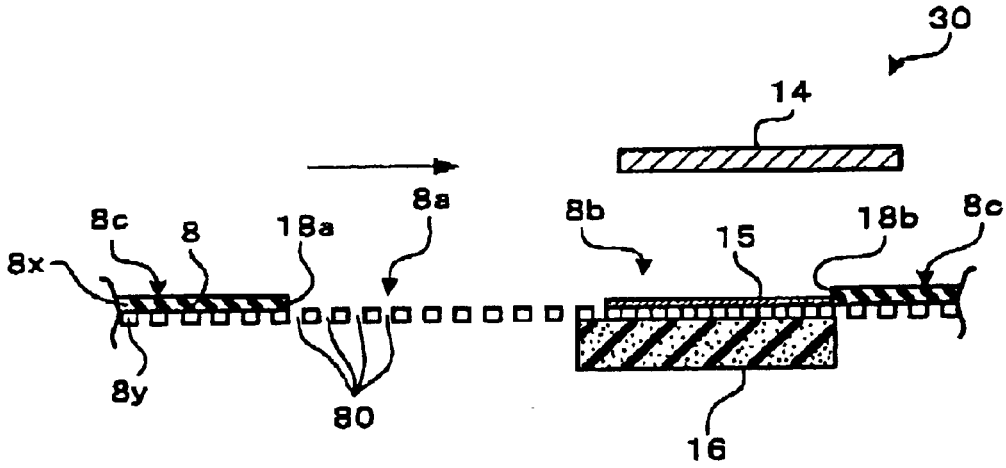
FIG. 2B is a cross-sectional view of the conveyor belt taken along line B—B of FIG. 2A.

Referring then to FIGS. 2A and 2B, description will be made of the configuration of the conveyor belt 8, as well as an ink mover 14 in the form of a blade and an ink retainer 16 in the form of a sponge block, both of which are located at the ink movement position 30. FIG. 2A is a schematic top view of the conveyor belt 8 depicted in FIG. 1. FIG. 2B is a cross-sectional view of the same taken along line B—B of FIG. 2A.

Figure 3A:
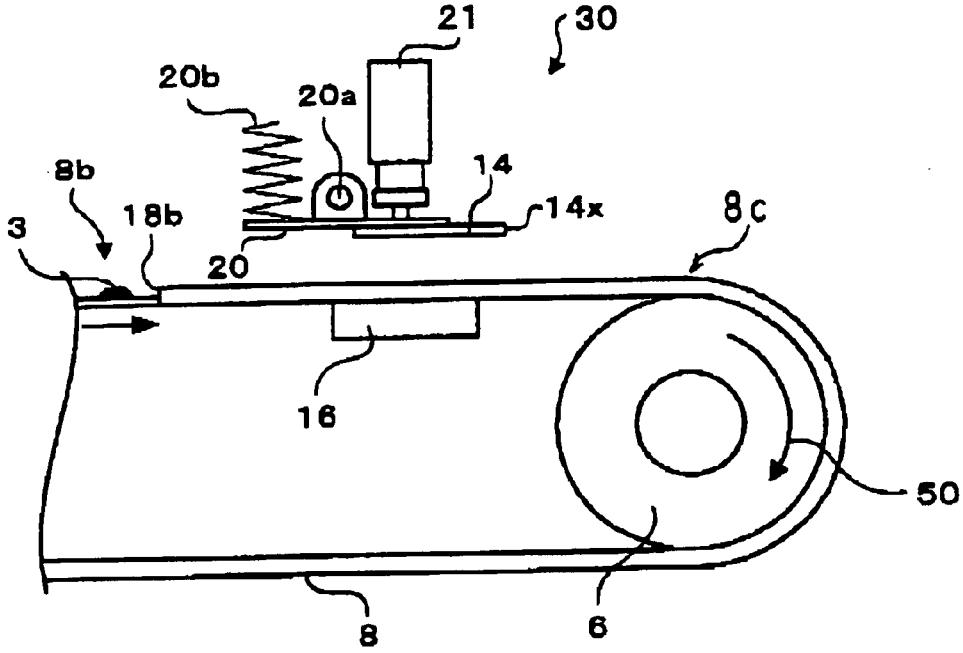
FIGS. 3A and 3B are enlarged views of ink movement positions, showing in progressive stages the movement of the ink mover.

The conveyor belt 8 includes thereon defined a meshed region 8*a* in which a multiplicity of openings 80 are adjacently formed and a flushing region 8*b* leading to downstream of the meshed region 8*a* in the traveling direction of the conveyor belt 8, i.e., in the direction indicated by the arrow in FIGS. 2A and 2B (hereinafter referred to simply as traveling direction). The region other than the above regions 8*a* and 8*b* of the conveyor belt 8 is a conveying surface 8*c* on which a paper is conveyed. When the flushing region 8*b* reaches a region confronting the ejecting surfaces of the heads 8 and ink is forcibly ejected from the nozzles for flushing, ink 3 is deposited on the flushing region 8*b* as shown in FIG. 3A.

The position of the openings 80 formed in the meshed region 8*a* is detectable by the photosensor 40 described above (see FIG. 1). The light-emitting unit 40*a* of the photosensor 40 emits light at all times toward the reverse surface of the conveyor belt 8. When the light passes through the openings 80 and is received by the light-receiving unit 40*b*, the openings 80 are detected as being at the position where the photosensor 40 is arranged. Based on this detected position of the openings and on the traveling speed of the conveyor belt 8, it is possible to recognize the positions of the meshed region 8*a* and of the flushing region 8*b* at any point of time.

In the meshed region 8*a*, as shown in FIG. 2B, the meshed polyester base material 8*y* is exposed with the surface silicone rubber sheet 8*x* removed. In the flushing region 8*b*, the surface silicone rubber sheet 8*x* is removed and the polyester base material 8*y* is overlaid with a water-repellent sheet 15 whose surface is coated with, e.g., a silicone agent for water-repellent treatment. This allows the flushing region 8*b* to have a water repellency with a contact angle of 15 degrees or more. The thickness of the water-repellent sheet is smaller than that of the silicone rubber sheet 8*x*.

Stepped portions 18*a* and 18*b* are formed respectively at the upstream boundary of the meshed region 8*a* and at the downstream boundary of the flushing region 8*b*. This means that the surfaces of the meshed region 8*a* and of the flushing region 8*b* defined by the stepped portions 18*a* and 18*b* are at lower levels than the level of the conveying surface 8*c* of the conveyor belt 8 other than those regions 8*a* and 8*b*. That is, the regions 8*a* and 8*b* defined by the stepped portions 18*a* and 18*b* are recessed.

The ink-jet printer 1 has a paper conveyance timing adjusted to convey paper through the areas other than the meshed region 8*a* and the flushing region 8*b*.

At the ink movement position 30, the blade 14 and the sponge block 16 are arranged confronting each other with the conveyor belt sandwiched therebetween, respectively over the front surface and the reverse surface of the conveyor belt 8. The blade 14 is a flat plate made of a flexible material such as rubber for example. The sponge block 16 is made of a high-molecular porous material such as urethane for example, and is positioned in contact with the reverse surface of the conveyor belt 8.

Figure 3B:
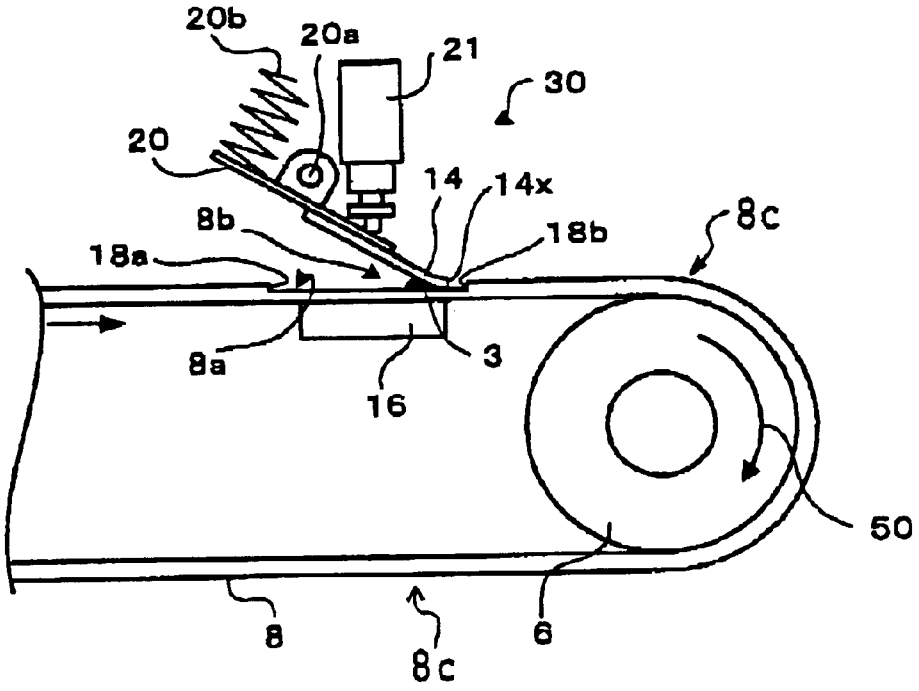

Referring then to FIGS. 3A and 3B, the movement of the blade 14 will be described hereinbelow.

The blade 14 is supported by a support plate 20 which is pivotally moved around a pivot 20*a*. The blade 14 is connected to the undersurface of one end, i.e., of the right-hand end in the diagram of the support plate 20, with a solenoid acting as a drive mechanism 21 being connected to the top surface of the one end of the support plate 20. A spring 20*b* is connected at its lower end to the top surface of the other end, i.e., of the left-hand end in the diagram of the support plate 20. The spring 20*b* is connected at its upper end to a securing portion not shown and urges the support plate 20 downward.

FIG. 3A shows the status before the flushing region 8*b* reaches the ink movement position 30 after flushing, with the flushed ink 3 being deposited on the flushing region 8*b*. At that time, the solenoid 21 is shut off in order that both the plate surface of the support plate 20 and the plate surface of the blade 14 supported by the support plate 20 become parallel to the surface of the conveyor belt 8. The undersurface of the blade 14 is spaced apart from the top surface of the conveyor belt 8 with a proper gap allowing at least a passage of paper therethrough.

Afterward, the blade 14 is moved at the timing when the flushing region 8*b* reaches the ink movement position 30. More specifically, the blade 14 is moved such that one end 14*x* of the blade 14 comes into contact with a surface of the flushing region 8*b* in the vicinity of the stepped portion 18*b*, Such an movement of the blade 14 is implemented by activating the solenoid 21 at a predetermined point of time based on the position of the openings 80 detected by the photosensor 40 as shown in FIG. 1 and on the traveling speed of the conveyor belt 8.

This movement of the blade 14 is achieved as follows, for example. A time period from a time point when the photosensor 40 detects the meshed region 8*a* until the flushing region 8*b* reaches the position corresponding to the blade 14 is calculated and stored in advance, based on the traveling speed of the conveyor belt 8, on a distance along the conveyor belt 8 between the position of the photosensor 40 and the position corresponding to the blade 14, and on a distance between the meshed region 8*a* and the flushing region 8*b*. Then the time period is stored. Accordingly, as a practical matter, after the photosensor 40 detects the meshed region 8*a* and then the stored time period passed, the blade 14 is moved toward the conveyor belt 8 so as to be in contact with the flushing region 8*b* by the drive mechanism.

It is preferred that the traveling speed of the conveyor belt 8 during the movement of the blade 14 be lower than that when the paper is being printed.

When the solenoid 21 is activated, the support plate 20 is pressed at its one end downward by the solenoid 21. This allows the support plate 20 to rotate clockwise, in the drawing plane of FIGS. 3A and 3B, around the pivot 20*a*, and thereby the other end of the support plate 20 on which the spring 10*b* is connected is moved upward. Then, the one end 14*x* of the blade 14 comes gradually nearer to the flushing region 8*b* of the conveyor belt 8. And immediately after the stepped portion 18*b* has passed the vicinity of the one end 14*x*, that one end 14*x* abuts against the surface of the flushing region 8*b*. Afterward, the blade 14 additionally makes a slight clockwise rotation and comes into intimate contact with the surface of the flushing region 8*b* as shown in FIG. 3B with the vicinity of the one end 14*x* flexed, At that time, although not shown in FIG. 3B, the blade 14 is in contact with the flushing region 8*b* across the overall width of the conveyor belt 8 in the direction perpendicular to the drawing plane of FIG. 3B.

The above status where the blade 14 is in contact with the flushing region 8*b* continues till the time immediately before the meshed region 8*a* completely passes the ink movement position 30. More specifically, the solenoid is shut off at a certain point of time previous to the completion of passage in order to ensure that the stepped portion 18*a* does not come into contact with the one end 14*x* of the blade 14. Then, the pressing of the solenoid 21 against the one end of the support plate 20 is released to allow the blade 14 to rotate counterclockwise around the pivot 20*a*, returning again to the status of FIG. 3A, with the other end of the support plate 20 urged by the spring 20*b*.

The area of the meshed region 8*a* and the material of the sponge block 16 are determined so as to ensure that substantially all the ink 3 is absorbed by the sponge block 16 before the meshed region 8*a* completely passes the ink movement position 30.

Figure 4A:
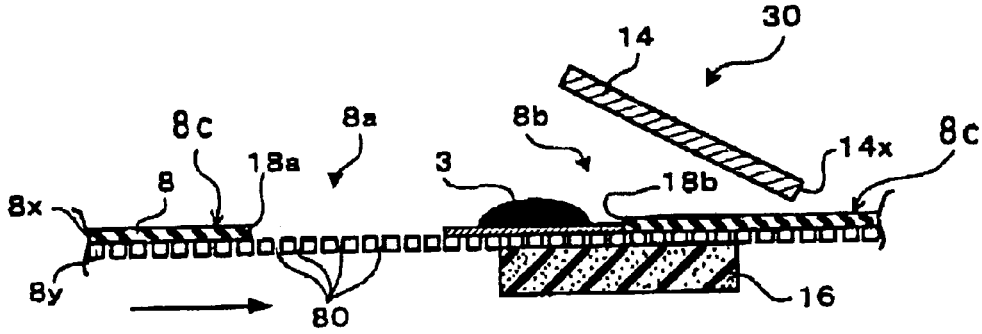
FIGS. 4A to 4C are cross-sectional views each corresponding to FIG. 2B, showing in progressive stages the movements of ink effected by the ink mover.
Figure 4B:
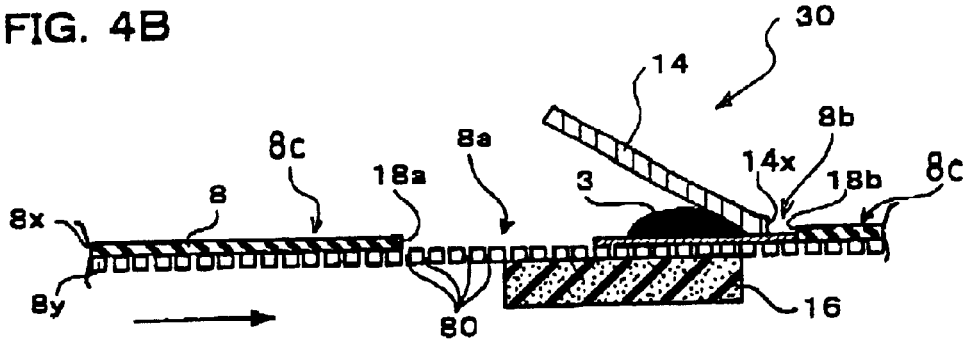
Figure 4C:
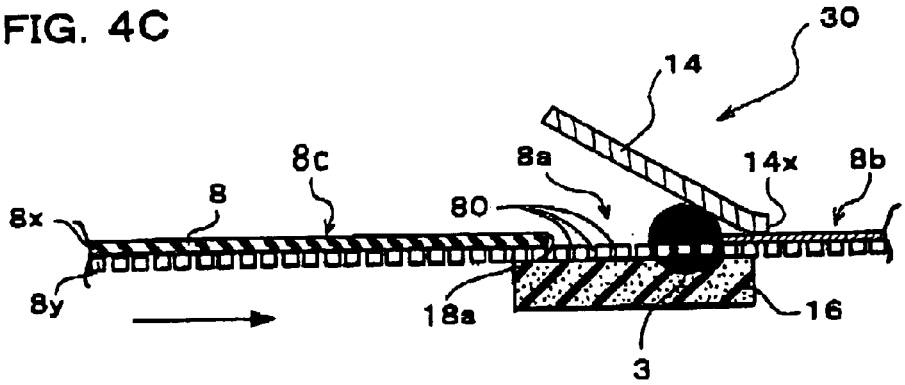

Referring then to FIGS. 4A to 4C, the movement of the ink 3 by the blade 14 will be described hereinbelow.

FIG. 4A shows the status immediately before the flushing region 8*b* reaches the ink movement position 30 after flushing. At that time, the blade 14 is tilted as a result of pressing of the solenoid 21 so that the blade 14 comes nearer to the surface of the conveyor belt 8 accordingly as it goes downstream in the traveling direction, i.e., to the right in the diagram. Immediately before the flushing region 8*b* reaches the ink movement position 30, the one end 14*x* of the blade 14 is spaced apart from the conveyor belt 8.

When the flushing region 8*b* reaches the ink movement position 30, as shown in FIG. 4B, the blade 14 is in contact with the flushing region 8*b* in such a manner that the plate surface in the vicinity of the one end 14*x* rests against the surface of the flushing region 8*b* with the vicinity of the one end 14*x* being flexed. FIG. 4B is a partially enlarged view of FIG. 3B. It can be seen that at that time the ink 3 is retained between the vicinity of the one end 14*x* and the surface of the flushing region 8*b*. When the conveyor belt 8 travels in the direction indicated by the arrow in this status, the ink 3 is restrained from being moved in the traveling direction while being retained between the vicinity of the one end 14*x* and the surface of the flushing region 8*b*. In other words, blade 14 moves the ink 3 upstream in the traveling direction in such a manner that the plate surface in the vicinity of the one end 14*x* of the blade 14 is rubbed on the flushing region 8*b*.

When the conveyor belt 8 further travels in the arrow direction from the status of FIG. 4B, the meshed region 8*a* reaches the ink movement position 30 as seen in FIG. 4C. The ink 3 moved by the blade 14 passes through the openings 80 and is retained by the sponge block 16. In this manner, the ink 3 deposited on the flushing region 8*b* is removed from the surface of the conveyor belt 8.

As set forth hereinabove, the ink-jet printer 1 in accordance with this embodiment is arranged such that ink 3 ejected onto the flushing region 8*b* of the conveyor belt 8 in a flushing operation is moved toward the meshed region 8*a* by the blade 14 so that the ink 3 passed through the openings 80 is retained by the sponge block 16. Accordingly, when flushing is performed, there is no need to retreat the conveyor belt 8 or the heads 2, ensuring a rapid flushing. Implementation of the rapid flushing enables continuous printing and high-speed printing.

Furthermore, the movement of ink by the blade 14 is performed in a region not confronting the ejecting surfaces of the ink-jet heads 2. In this case, the sponge block 16 is arranged in a region not confronting the ejecting surfaces of the ink-jet heads 2. Therefore, it is possible to dispose the flexure prevention member 13 such as a flat plate on a substrate undersurface of the conveyor belt 8 confronting the heads 2. Due to the presence of this flexure prevention member, the conveyance belt 8 is kept level in the printing region so that excellent image formations can be implemented.

Since the blade 14 can selectively take either a first location of FIG. 4A spaced apart from the conveyor belt 8 or a second location of FIG. 4B in contact with the flushing region 8*b*, it is possible for example to take the first location when paper is printed and to take the second location when flushed ink 3 needs to be moved. As a result, ink adhered to the blade 14 can be prevented from adhering to the conveying surface 8*c* of the conveyor belt 8.

Due to the blade 14 being in the form of a flat plate, the ink 3 can be moved by a simple structure as in this embodiment.

Due to the blade 14 being in contact with the flushing region 8*b* across the overall width of the conveyor belt 8, a relatively large amount of ink 3 can smoothly be moved as compared with the case where the blade 14 is in contact with only a part in the width direction of the conveyor belt 8.

Due to the blade 14 being made of a flexible material such as rubber so that the blade 14 flexes at the vicinity of its one end 14*x* when coming into contact with the flushing region 8*b*, the conveyor belt 8 can be prevented from being damaged when the ink 3 is moved.

By virtue of such an arrangement that the blade 14 moves the flushed ink 3 such that the plate surface in the vicinity of the one end 14*x* is rubbed on the flushing region 8*b*, ink 3 can smoothly be moved.

Since the ink 3 is moved by the blade 14 while the conveyor belt 8 is traveling, rapid flushing can be effected without stopping the conveyor belt 8. In this case, the blade 14 only has to mainly be moved vertically, resulting in a simplified drive mechanism for moving the blade 14.

Since the water repellency having a contact angle of 15 degrees or more in this embodiment is imparted to the flushing region 8*b*, it is possible to more smoothly move the ink 3 deposited on the flushing region 8*b*.

Since the flushing region 8*b* is recessed from the conveying surface 8*c*, it is difficult for the flushed ink 3 to leave the recessed portion. Accordingly, the ink 3 can be prevented from scattering within the interior of the apparatus.

By virtue of the flushed ink 3 being deposited downstream in the traveling direction of the meshed region 8*a*, the action of moving the ink 3 toward the openings 80 by the blade 14 can effectively be performed while the conveyor belt 8 is traveling. Thus, effects can be obtained as discussed above for example that the rapid flushing is implemented and that the mechanism for moving the blade 14 becomes simplified.

Due to a number of openings 80 being provided adjacent to each other to form the meshed region 8*a*, the strength of the conveyor belt 8 is enhanced as compared with the case where a single large opening is provided for example.

Figure 5A:
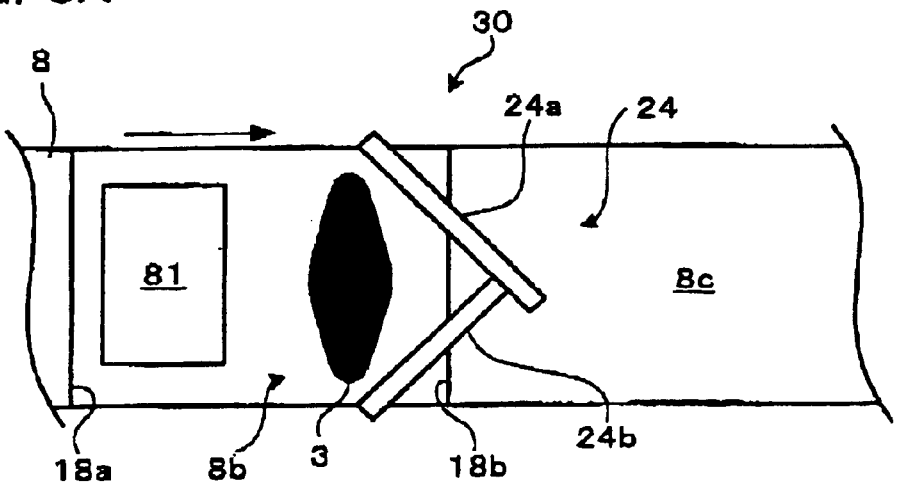
FIGS. 5A and 5B are schematic top views showing in progressive stages the movements of ink in a variant of the conveyor belt and of the ink mover.
Figure 5B:
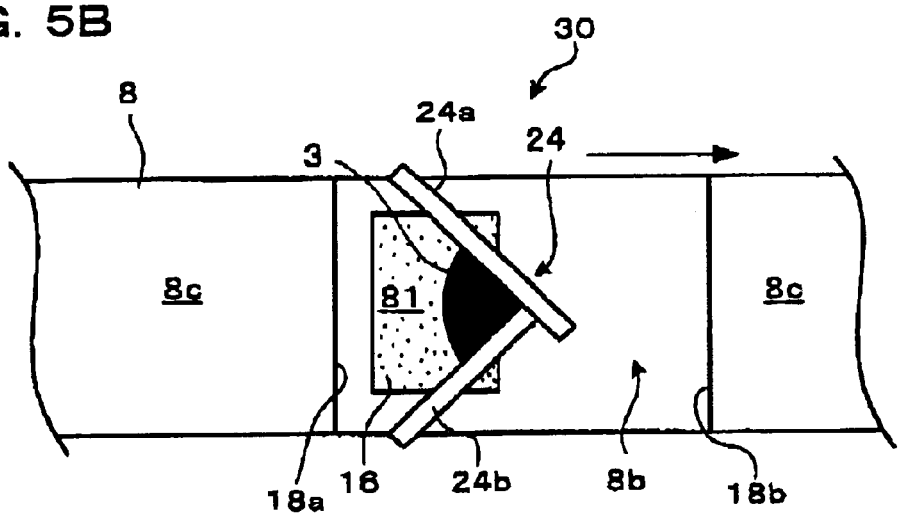
Figure 5C:
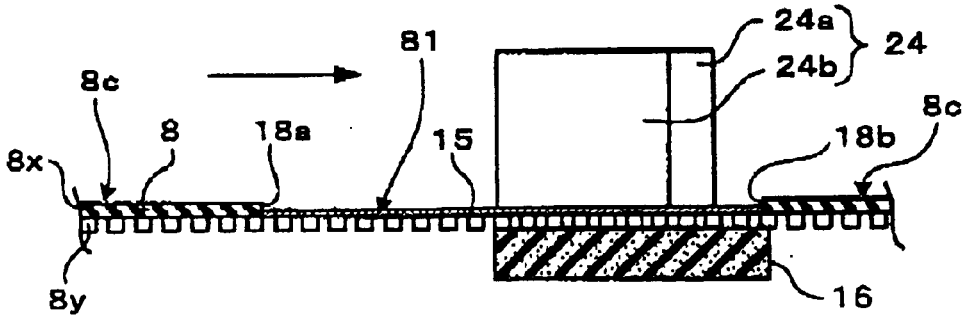
FIG. 5C is a cross-sectional view of the conveyor belt corresponding to that of FIG. 2 in the variant shown in FIGS. 5A and 5B.

The openings formed in the conveyor belt and the ink mover are not limited to those in this embodiment, but instead they may be configured as shown in FIGS. 5A to 5C. FIGS. 5A and 5B are schematic top views showing in progressive stages the movement of ink in a variant of the openings and of the ink mover. FIG. 5C is a cross-sectional view of the conveyor belt corresponding to FIG. 2B in the variant shown in FIGS. 5A and 5B. The other constituent elements than the openings and the ink mover are the same as those in the above embodiment, and hence will be designated by the same reference numerals which will not again be described hereinbelow.

The ink mover of this variant is in the form of a blade pair 24 consisting of a first blade, first flat plate 24*a* and of a second blade, second flat plate 24*b*. The first and second blades 24*a* and 24*b* are both generally rectangular members made of a flexible material such as rubber for example and are located such that their plate surfaces are substantially perpendicular to the conveyor belt 8.

The first and second blades 24*a* and 24*b* are deployed such that the downstream end-to-end distance between them in the traveling direction is smaller than the upstream end-to-end distance between them in the traveling direction. More specifically, deployment is such that one ends of the first and second blades 24*a* and 24*b* slightly project from both edges in the width direction of the conveyor belt 8 and that the other ends lie at or near the center in the width direction of the conveyor belt 8 downstream with respect to the one ends. In other words, the first blade 24*a* is inclined, from one end to the other end in the width direction of the conveyor belt 8, toward upstream of a direction in which ink 3 is moved by the blade 14, while the second blade 24*b* is inclined, from the other end to the one end in the width direction of the conveyor belt 8, toward upstream of the ink moved direction. Accordingly, the blade pair 24 is of a V-shape, the each lines of the V shape inclined each other, from respective ends to a center in the width direction of the conveyor belt 8, toward upstream of the ink moved direction.

The first blade 24*a* is slightly longer than the second blade 24*b* and their respective other ends are in contact with each other in the center in the width direction of the conveyor belt 8. More precisely, the other end of the second blade 24*b* is not in contact with the other end of the first blade 24*a* but instead is in contact with a slightly upstream surface, toward the one end, in the traveling direction with respect to the other end of the first blade 24*a*. In addition, the first blade 24*a* and the second blade 24*b* overlap with each other in the width center of the conveyor belt 8.

The first and second blades 24*a* and 24*b* are positioned such that their respective one ends slightly project from both the edges in the width direction so that the blade pair 24 is in contact with the conveyor belt 8 across the overall width of the conveyor belt 8.

In this variant, the conveyor belt 8 is formed with a single opening 81 which is larger than the area of the openings 80 of the above embodiment.

In a region defined by the stepped portions 18*a* and 18*b*, as shown in FIG. 5C, the surface silicone rubber sheet 8*x* is removed and the polyester base material 8*y* is overlaid with the water-repellent sheet 15 similar to that of the above embodiment. That is, the region defined by the stepped portions 18*a* and 18*b* is of a two-layer structure of the polyester base material By and the water-repellent sheet 15, with the opening 81 extending through the two layers.

It is to be noted that this variant does not include the meshed region 8*a* of the above embodiment. The flushing region 8*b* is arranged downstream in the traveling direction with respect to the opening 81 in the recessed portion defined by the stepped portions 18*a* and 18*b*.

The sponge block 16 is formed such that its length along the traveling direction is greater than the length of the blade pair 24 in the traveling direction and that its length along the direction orthogonal to the traveling direction is greater than the length of the opening 81 in the direction orthogonal to the traveling direction. The thus formed sponge block 16 is positioned at the width center of the conveyor belt 8 in such a manner as to embrace a region occupied by the blade pair 24 in the traveling direction as shown in FIG. 5C. Such a situation is thus obviated that the ink 3 collected at the width center as shown in FIG. 5B passes through the opening 81 and scatters within the interior of the apparatus without being retained by the sponge block 16.

In such an arrangement, the ink 3 deposited in the flashing region 8*b* is collected at the width center by the blade pair 24 as shown in FIG. 5A and then is moved toward the opening 81 as shown in FIG. 5B. The ink 3 passed through the opening 81 is absorbed and retained by the sponge block 16 arranged on the reverse side of the conveyor belt 8.

In the same manner as the above embodiment, the blade pair 24 acting as the ink mover of this variant can also selectively take either a first location spaced apart from the conveyor belt 8 or a second location in contact with the flushing region 8*b* of the conveyor belt 8. Similar to the above embodiment, the solenoid 21 is activated or deactivated based on the position of the opening 81 detected by the photosensor 40 and on the traveling speed of the conveyor belt 8, so that the first and second blades 24*a* and 24*b* are vertically moved together. While the ink 3 does not need to be moved, the first and second blades 24*a* and 24*b* are kept apart from the surface of the conveyor belt 8 by a proper gap enough to allow at least the passage of paper there through. The first and second blades 24*a* and 24*b* lower in synchronism with the timing when the flushing region 8*b* reaches the ink movement position 30, and come into contact with the surface of the flushing region 8*b* after the stepped portion 18*b* has passed the other end of the first blade 24*a*. This status continues until at least the downstream end of the opening 81 in the traveling direction reaches the contact portions of the first and second blades 24*a* and 24*b*. The blade pair 24 rises before the upstream ends of the blade pair 24 in the traveling direction come into contact with the stepped portion 18*a* in order to prevent the blade pair 24 from being in contact with the stepped portion 18*a*, and returns again to the status where it is spaced apart from the surface of the conveyor belt 8.

As set forth hereinabove, this variant enables the same schemes as those of the above embodiment to have the same effects as those of the above embodiment and further can have the following effects unlike the above embodiment.

First, since the first and second blades 24*a* and 24*b* making up the blade pair 24 are deployed such that the downstream end-to-end distance between them in the traveling direction is smaller than the upstream end-to-end distance between them in the traveling direction, the ink 3 can be collected at the width center of the conveyor belt 8 downstream in the traveling direction. Accordingly, the ink 3 has less possibility of flowing out of both edges in the width direction of the conveyor belt 8, achieving effective movement of the ink 3 to the opening 81. This effect can also be obtained by the feature that the upstream contour in the traveling direction at the contact surface of the blade pair 24 with the conveyor belt 8 is of a V-shape protruding downstream in the traveling direction.

Due to the first and second blades 24*a* and 24*b* being in contact with each other, another problem can be alleviated that the ink 3 may partially pass through a gap therebetween so that it becomes difficult to move all the ink 3 to the opening 81. In case the conveyor belt 8 travels with part of the ink 3 unmoved to the opening 81, the ink may possibly scatter within the interior of the apparatus. The above effect can be obtained also by the first and second blades 24*a* and 24*b* overlapping each other in the width center of the conveyor belt 8. Although the first and second blades 24*a* and 24*b* making up the blade pair 24 of this variant are in contact with each other, the above effect can be obtained as long as they overlap each other even though they are space apart from each other. In this variant, the first and second blades 24*a* and 24*b* are in contact with each other and simultaneously overlap each other in the width center of the conveyor belt 8, thus obtaining the above effect more securely.

The ink movement position is not limited to the position shown in FIG. 1 as long as it is in a region of the conveyor belt 8 not confronting the ejecting surfaces of the heads 2. From the viewpoint of preventing the flushed ink 3 from scattering within the interior of the apparatus, it is preferred that the ink movement position be provided between the heads 2 and the rollers 6.

One or more openings may be formed in the conveyor belt 8.

The flushing region 8*b* may not necessarily be recessed from the conveying surface 8*c*. It is however preferred that the flushing region 8*b* be recessed from the conveying surface 8*c* from the viewpoint of preventing the flushed ink 3 from scattering within the interior of the apparatus.

The water repellency may not be imparted to the flushing region 8*b*.

The flushing region 8*b* is not limited to being arranged downstream in the traveling direction of the meshed region 8*a* or the opening 81, but maybe arranged for example upstream in the traveling direction of the meshed region 8*a* or the opening 81. In order to ensure the effective action of moving the ink 3 to the meshed region 8*a* or the opening 81, however, it is preferred that the flushing region 8*b* be arranged downstream in the traveling direction of the meshed region 8*a* or the opening 81.

The ink 3 is not limited to being moved by the blade 14 or the blade pair 24 when the conveyor belt is being traveling, but instead the ink may be moved while the conveyor belt 8 is stopped.

The ink retainer is not limited to the sponge block 16 made of a high-molecular porous material capable of absorbing ink, but instead it may be any member such as receptacles capable of storing the ink, as long as it can retain the ink so as to prevent the ink from scattering within the interior of the apparatus.

The ink mover is not limited to being configured from a flat plate as long as it can move the ink 3, but instead it may be other various forms of members. The ink mover is not limited to the member made of a flexible material.

Although the blade pair 24 of the variant is composed of two members, i.e., the first and second blades 24*a* and 24, it may be substituted by a single flat plate bent into a V-shape.

The drive mechanism for moving the blade 14 or the blade pair 24 is not limited to the mechanism using the solenoid 21, etc.

The position to dispose the photosensor 40 is not limited to the position shown in FIG. 1. Other various types of sensors than the photosensor are usable as long as they can detect the position of the conveyor belt 8, especially, of the openings 80 or the opening 81.

The present invention is not limited to the ink-jet printer but is applicable to, e.g., ink-jet type fax machines and copiers as well.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes maybe made without departing from the spirit and scope of the invention as defined in the following claims.

What is claimed is:

1. An ink-jet recording apparatus comprising:

a plurality of rollers;

a conveyor spanning the plurality of rollers for conveying a record medium thereon, the conveyor including a conveying surface on which a record medium is conveyed, a flushing region onto which ink is ejected when flushing is performed, and an opening arranged adjacent to the flushing region;

an ink-jet head arranged confronting the conveyor belt, for ejecting ink onto the flushing region of the conveyor belt;

an ink mover for moving ink ejected from the ink-jet head onto the flushing region toward the opening, the ink mover arranged confronting the conveyor belt; and an ink retainer for retaining ink moved by the ink mover and passed through the opening, the ink retainer arranged confronting the ink mover under the conveyor belt.

2. The ink-jet recording apparatus according to claim 1, wherein the ink mover is selectively either at a first position spaced apart from the conveyor belt or at a second position in contact with the flushing region of the conveyor belt.

3. The ink-jet recording apparatus according to claim 1, wherein the ink mover comprises a flat plate.

4. The ink-jet recording apparatus according to claim 3, wherein the ink mover moves ink toward the opening making the flat plate rub the flushing region.

5. The ink-jet recording apparatus according to claim 1, wherein the ink mover is in contact with the flushing region across the whole width of the conveyor belt.

6. The ink-jet recording apparatus according to claim 1, wherein the ink mover is formed from a flexible material and wherein the ink mover contacts with the flushing region with bending.

7. The ink-jet recording apparatus according to claim 1, wherein the ink mover is of a V-shape, the each lines of the V shape inclined toward other, from respective ends to a center in a width direction of the conveyor belt, toward upstream of a direction in which ink is moved by the ink mover.

8. The ink-jet recording apparatus according to claim 1, wherein the ink mover includes a first flat plate and a second flat plate, the first flat plate inclined, from one end to the other end in a width direction of the conveyor belt, toward upstream of a direction in which ink is moved by the ink mover, the second flat plate inclined, from the other end to the one end in a width direction of the conveyor belt, toward upstream of a direction in which ink is moved by the ink mover.

9. The ink-jet recording apparatus according to claim 8, wherein the first and the second flat plates are in contact with each other.

10. The ink-jet recording apparatus according to claim 8, wherein the first and the second flat plates overlap with each other in the width center of the conveyor belt.

11. The ink-jet recording apparatus according to claim 1, wherein the flushing region has a water repellency.

12. The ink-jet recording apparatus according to claim 1, wherein the flushing region has a water repellency providing a contact angle of 15 degrees or more.

13. The ink-jet recording apparatus according to claim 1, wherein the flushing region is recessed from the conveying surface.

14. The ink-jet recording apparatus according to claim 1, wherein the flushing region is arranged downstream of the opening in the running direction of the conveyor belt.

15. The ink-jet recording apparatus according to claim 1, wherein the opening has meshes.

16. An ink-jet recording apparatus comprising:

a plurality of rollers;

a conveyor spanning the plurality of rollers for conveying a record medium thereon, the conveyor including a conveying surface on which a record medium is conveyed, a flushing region onto which ink is ejected when flushing is performed, and an opening arranged adjacent to the flushing region;

an ink-jet head arranged confronting the conveyor belt, for ejecting ink onto the flushing region of the conveyor belt;

a sensor for sensing a position of the opening included in the conveyor belt;

an ink mover for moving ink ejected from the ink-jet head onto the flushing region toward the opening, the ink mover arranged confronting the conveyor belt;

a drive mechanism for moving the ink mover to a position where the ink mover is in contact with the flushing region, based on a position of the opening sensed by the sensor and on a running speed of the conveyor belt; and an ink retainer for retaining ink moved by the ink mover and passed through the opening, the ink retainer arranged confronting the ink mover under the conveyor belt.

17. The ink-jet recording apparatus according to claim 16, wherein the drive mechanism moves the ink mover while the conveyor belt is running.

* * * * *